US006070727A

United States Patent [19]

Tindoll et al.

[11] Patent Number: 6,070,727

[45] Date of Patent: Jun. 6, 2000

[54] COLLAPSIBLE CORNER PROTECTOR

[75] Inventors: Avalon Tindoll; Stanley Hendrix, both of Tupelo; Brian P. Tindoll; J. Scott Tindoll, both of Saltillo, all of Miss.

[73] Assignee: Manufacturer's Equipment & Supply Company, Inc., Tupelo, Miss.

[21] Appl. No.: 09/295,384

[22] Filed: Apr. 21, 1999

[51] Int. Cl.[7] ..... B65D 81/05

[52] U.S. Cl. ..... 206/522; 206/523; 206/586

[58] Field of Search ..... 150/154, 158, 150/161; 206/453, 522, 523, 586; 383/902, 907

[56] References Cited

U.S. PATENT DOCUMENTS

| | | | |
|---|---|---|---|
| 1,157,568 | 10/1915 | Mills | 383/907 |
| 2,728,451 | 12/1955 | Leander | 206/453 |
| 3,428,167 | 2/1969 | Sheng | 150/154 |
| 3,948,436 | 4/1976 | Bambera | 206/523 |
| 5,738,893 | 4/1998 | Kornet et al. | 383/907 |

*Primary Examiner*—Jim Foster
*Attorney, Agent, or Firm*—Young & Thompson

[57] ABSTRACT

A corner protector comprising a pair of layers of padding material superposed on each other and open along one edge and closed along three other edges by securement of the layers of padding material against each other. The three closed edges comprise a central edge joined at each of its ends to a closed edge at an obtuse angle of 135°. The three closed edges are straight, and the central edge is substantially shorter than the other two closed edges and parallel to the open edge. Each closed edge other than the central edge meets the open edge at an angle of 45°. To protect a corner of an object, the corner protector is bent until the two closed edges other than the central edge are disposed parallel to each other and spaced apart a distance equal to the length of the central edge, thereby to form a pocket, and the corner to be protected is inserted into this pocket.

8 Claims, 3 Drawing Sheets

COLLAPSIBLE CORNER PROTECTOR

FIELD OF THE INVENTION

The present invention relates to a protector for the corners of objects of substantial thickness, which protector is nevertheless collapsible to lie flat.

BACKGROUND OF THE INVENTION

Corner protectors for material of substantial thickness are known, which are fitted to the shape of the corner to be protected and hence easily slip over that corner.

Such corner protectors often offer excellent protection from potentially damaging forces applied in any direction to the material of the corner. However, such corner protectors are difficult to manufacture and assemble, and, because they match the bulk of the corner to be protected, are bulky and difficult to store.

OBJECTS OF THE INVENTION

It is accordingly an object of the present invention to provide a corner protector for material of substantial thickness, which can be stored in a flattened condition in which it occupies relatively little space, but which can be easily erected to match the shape of a corner to be protected on material of substantial thickness.

It is another object of the present invention to provide such a corner protector, which is simple and inexpensive to manufacture from a minimum of material.

SUMMARY OF THE INVENTION

The invention is the discovery that the objects of the invention, recited above, can be achieved by providing a corner protector formed from two superposed sheets of protective material, with seams or fold lines along three edges that join at angles of 135°.

When the corner protector is erected, the middle seam runs transversely of the thickness of the object to be protected and the other two seams or fold lines lie flat in the planes of the major faces of the protected object and at a 45° angle from the protected corner thereof.

In this way, a corner protector can be simply and quickly and easily formed, by folding or seaming a flat material with cushioning properties to provide a generally triangular envelope with one side open and the apex truncated which is opposite that open side.

Ordinarily, that truncated side, opposite the open side, will be shorter than the two adjacent sides which are seamed or folded.

It is also possible to leave the truncated edge open, that is, with the adjacent edges unsecured to each other. However, this is less preferred, as it does not offer the same degree of protection to the corner of the object to be protected, as is provided by a corner protector seamed or folded along the truncated edge.

When the corner protector is erected from its flattened condition, by bringing the two longer seams toward each other and into parallel relation with each other, there is naturally formed a corner protector which has substantially the same shape as the corner to be protected. In this erected condition, the truncated edge extends across the thickness of the erected protector, at the closed corner thereof, and the two seams or fold lines on opposite sides of and adjoining the truncated edge extend parallel to each other, and are spaced apart from each other a distance equal to the length of the truncated edge, at angles of 45° to what are now the two closed edges of substantial width, of the protector. The resulting shape matches the shape of the corner of the object to be protected, and so the corner protector can be quickly erected on the protected corner itself, that is, in situ. In the erected and assembled condition, the corner protector can exactly match the shape of the protected corner and so will tend to be self-retaining on the protected corner even if no additional securement is provided to hold the corner protector on the protected corner.

BRIEF DESCRIPTION OF THE DRAWINGS

Other objects, features and advantages of the present invention will become apparent from a consideration of the following description, taken in connection with the accompanying drawings, in which.

DETAILED DESCRIPTION OF THE INVENTION

Figure 1:
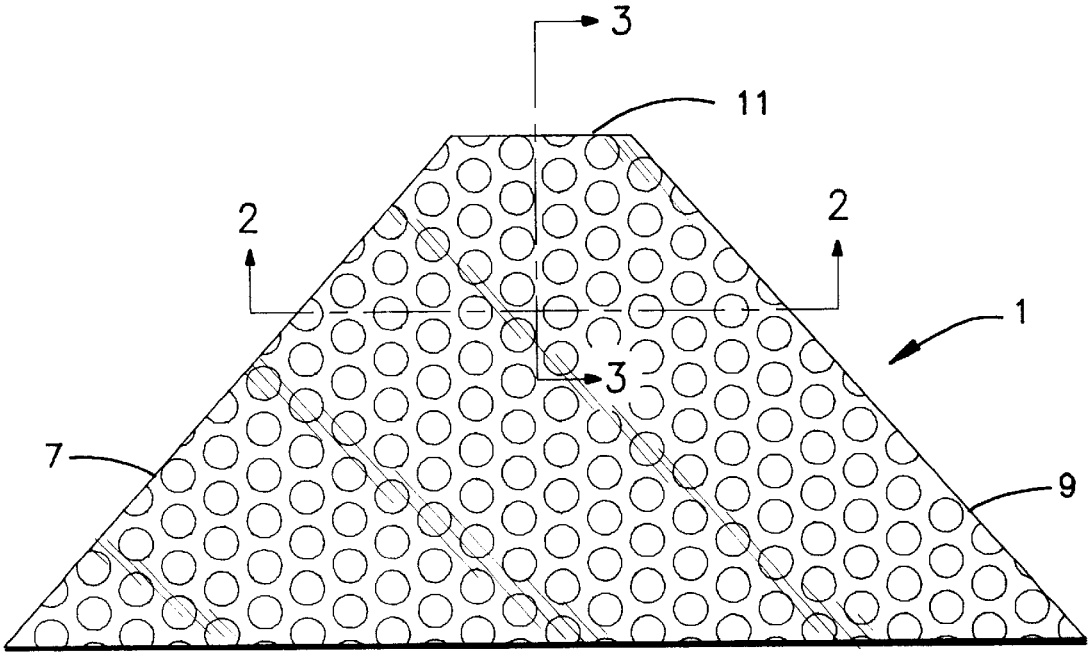
FIG. 1 is an elevational view of a corner protector for sheet material, according to the invention, shown in its flattened condition.
Figure 2:
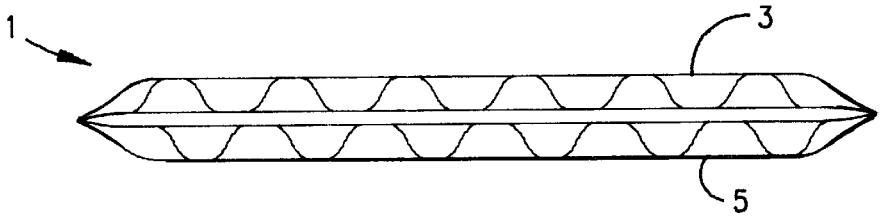
FIG. 2 is a cross-sectional view taken on the line 2—2 of FIG. 1.
Figure 3:
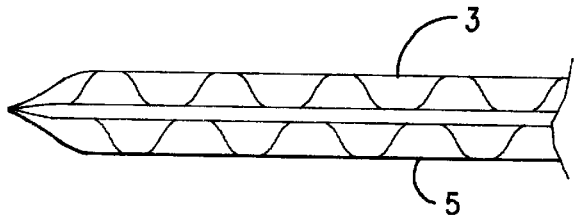
FIG. 3 is a fragmentary cross-sectional view taken on the line 3—3 of FIG. 1.

Referring now to the drawings in greater detail, there is shown in FIG. 1 a corner protector according to the present invention, comprising a pair of superposed sheets 3 and 5 of protective material such as plastic foam or plastic bubble sheet, preferably air bubble plastic.

The two sheets 3 and 5 are joined together along three edges 7, 9 and 11, leaving an envelope that is open at what is the lower edge in FIG. 1 but closed on the other three sides. The edges 7, 9 and 11 are preferably formed by heat welding the free edges of two sheets 3 and 5 together; but this can also be achieved by gluing. Also, one of the edges 7, 9 or 11 can be formed by folding over identical mirror image halves of the protector, each half constituting one of the sheets 3 and 5, thereby to form a folded edge about which the material of the corner protector is continuous.

The two edges 7 and 9 form an angle of 45° with the open side at the bottom of FIG. 1; and the edge 11 forms an angle of 135° with each of the edges 7 and 9, which it joins at its opposite ends.

Figure 5:
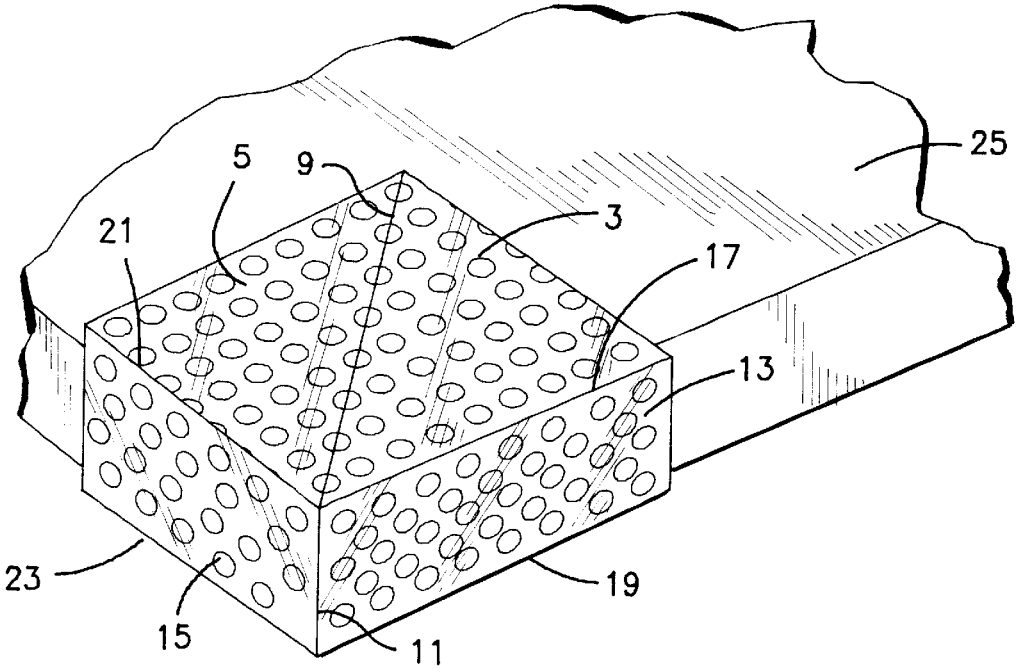
FIG. 5 is perspective view of a corner protector according to the invention, in fully erected condition, showing a protected corner in place therein.
Figure 4:
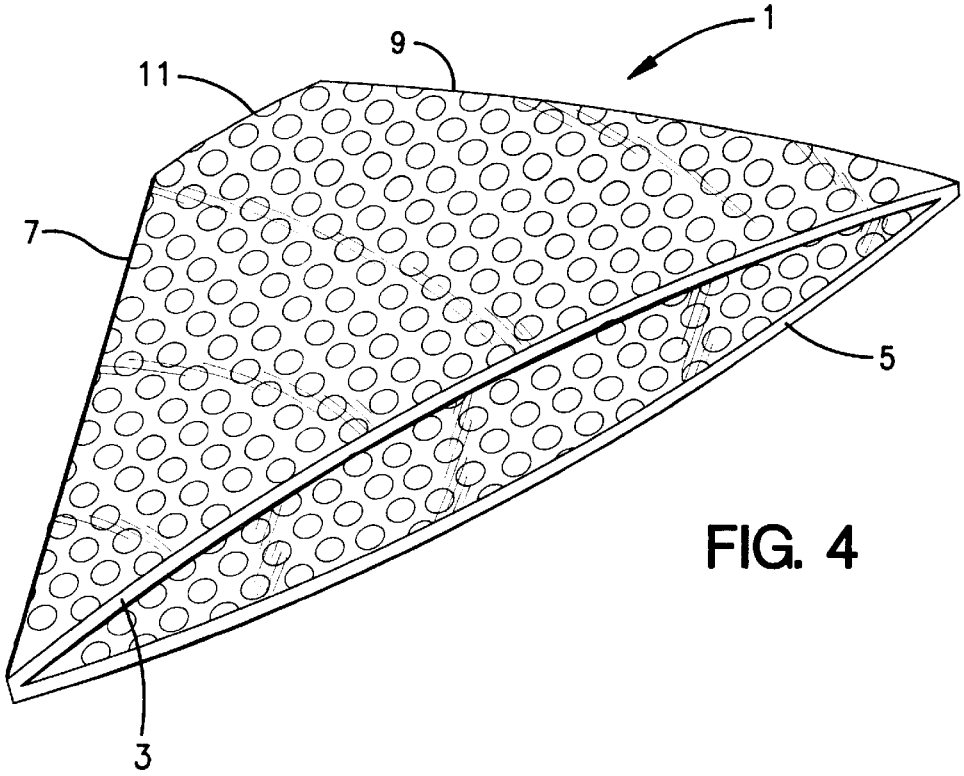
FIG. 4 is a perspective view of a corner protector according to the invention, in its flattened condition but with the components thereof partially spread apart.

FIG. 5 of the drawings shows the corner protector in erected condition, wherein the edges 7 and 9 have been brought toward each other into parallelism with each other and of course spaced apart a distance equal to the length of edge 11 which they adjoin. In this erected condition, the protector will have four sides: a large flat side formed by portions of sheets 3 and 5 on opposite sides of edge 9; a similar side not shown in FIG. 5, formed by contiguous portions of sheets 3 and 5 on opposite sides of edge 7; and two new sides 13 and 15 contiguous to edge 11 and perpendicular to each other and at right angles to the other two sides in which the edges 7 and 9 respectively lie. Side 13 is formed entirely from sheet 3 and side 15 is formed entirely from sheet 5.

Four more edges will also appear in the erected condition of the protector, namely, new edges 17 and 19 parallel to each other and bordering new side 13 and terminating in edge 11, and new edges 21 and 23, again parallel to each other, bordering new side 15 and also terminating in edge 11.

New edges 17, 19, 21 and 23 are not preformed and so will not be sharp edges, nor need they be: they serve the protective function equally well whether sharp or rounded.

Notice that edges 7 and 9 now lie at an angle of 45° relative to the edges of the sides in which they respectively lie. Thus, edge 9 lies at a 45° angle to and in the same * plane as edges 17 and 21 and has a common terminus with edges 17 and 21 at one end of edge 11. Similarly, edge 11 lies in the same plane as edges 19 and 23, at a 45° angle thereto, and has a common terminus with edges 19 and 23 at the opposite end of edge 11.

FIG. 5 shows the corner protector 1 fully engaged on the corner of an object 25 to be protected. The length of edge 11 will accordingly be selected to be about the thickness of object 25. A supply of corner protectors 1 will be maintained, having various lengths of edge 11, thereby to fit various objects whose corners are to be protected, such as mirrors, picture frames, table tops, etc. In this connection, it is to be noted that a snug fit between corner protector and protected corner is desirable, as this may reduce or even eliminate the need to secure the corner protector to the protected corner by any extraneous means.

Figure 6:
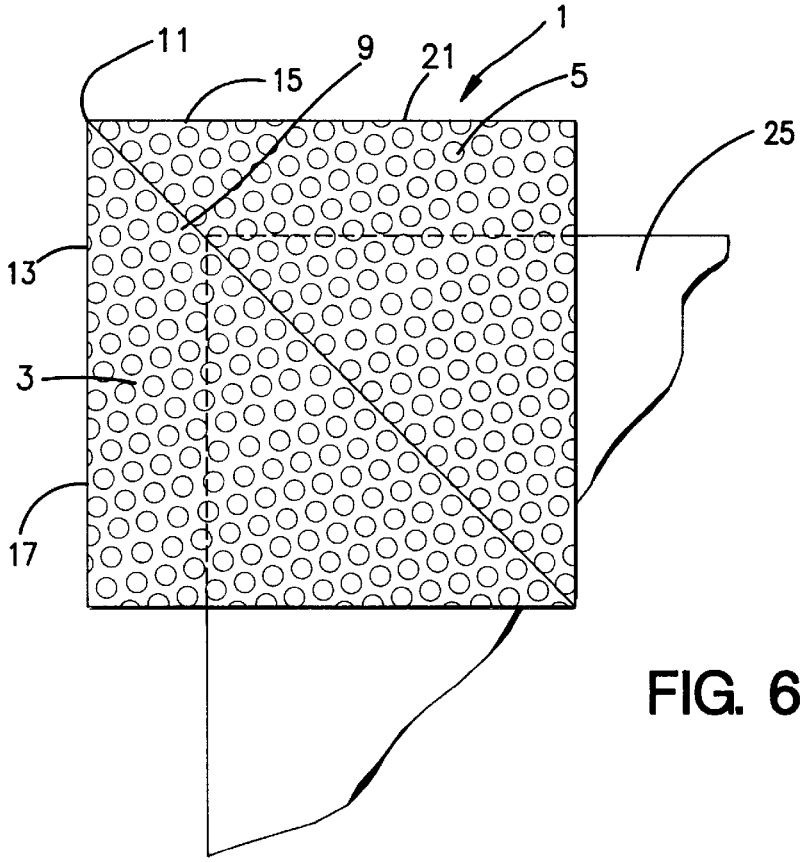
FIG. 6 is a top plan view showing a protected corner partially inserted in a fully erected corner protector according to the invention.

FIG. 6 shows a further view of the corner protector and the protected corner, in partially assembled condition, thereby more clearly to illustrate the relationship between the respective edges and sides.

In view of the foregoing, therefore, it will be seen that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A corner protector comprising a pair of layers of padding material superposed on each other and open along one edge and closed along three other edges by securement of the layers of padding material against each other, said three closed edges comprising a central edge joined at each of its ends to a said closed edge at an angle of 135°.

2. A protector as claimed in claim 1, said three closed edges being straight.

3. A protector as claimed in claim 1, said central edge being substantially shorter than the other two closed edges.

4. A protector as claimed in claim 1, said central edge being parallel to said open edge.

5. A protector as claimed in claim 1, each said closed edge other than said central edge meeting said open edge at an angle of 45°.

6. A protector as claimed in claim 1, said closed edges other than said central edge being disposed at 90° to each other.

7. A method of protecting a corner of an object, comprising bending a corner protector as claimed in claim 1 until the two said closed edges other than said central edge are disposed parallel to each other and spaced apart a distance equal to the length of said central edge, thereby to form a pocket, and inserting a corner to be protected into said pocket.

8. The assembly of a corner protector and a protected corner produced by the method of claim 7.

* * * * *